US006389930B1

(12) United States Patent
Gore

(10) Patent No.: US 6,389,930 B1
(45) Date of Patent: May 21, 2002

(54) HOSE CLAMP TOOL

(76) Inventor: David Timothy Gore, 5904 Count Tuff Dr., Louisville, KY (US) 40272

( * ) Notice: Subject to any disclaimer, the term of this patent is extended or adjusted under 35 U.S.C. 154(b) by 0 days.

(21) Appl. No.: 09/620,985

(22) Filed: Jul. 21, 2000

(51) Int. Cl.[7] ..... B25B 33/00
(52) U.S. Cl. ..... 81/55; 81/9.3
(58) Field of Search ..... 81/9.3, 13, 55

(56) References Cited

U.S. PATENT DOCUMENTS

| | | | | | |
|---|---|---|---|---|---|
| 1,282,523 | A | | 10/1918 | Bauer | |
| 1,294,857 | A | | 2/1919 | Yuucker | |
| 1,390,071 | A | | 9/1921 | Wetzstein | |
| 2,033,892 | A | | 3/1936 | Parvin | |
| 2,600,214 | A | * | 6/1952 | Davis | 81/55 |
| 2,704,474 | A | * | 3/1955 | South | 81/55 |
| 2,910,899 | A | | 11/1959 | Pasqualoue et al. | |
| 4,193,327 | A | * | 3/1980 | Lares et al. | 81/55 |
| 4,358,971 | A | * | 11/1982 | Favinio | 81/55 |
| 4,836,062 | A | | 6/1989 | La Torre | |
| 5,063,652 | A | | 11/1991 | Roberge | |
| 5,069,861 | A | | 12/1991 | Lagarrique | |

* cited by examiner

*Primary Examiner*—James G. Smith
(74) *Attorney, Agent, or Firm*—Carrithers Law Office; David W. Carrithers

(57) ABSTRACT

A tool, for use in turning the screw on a hose clamp, in which a shaft is slidably and rotatably mounted on an elongate slender body member and resiliently biased toward an abutment on the body member to grasp there between the screw on the hose clamp. The shaft has a tool head end to drivingly engage the screw head and at the other end a handle or socket for use in turning the shaft. The abutment on the body has a recess to receive therein the free outer end of the hose clamp screw. This recess and the socket on the drive head end maintain the screw and drive in axial alignment during use. A lug on the body member projects toward and terminates proximate a leading end portion of the shaft turning handle. The lug and its proximity to the handle make it easy to manipulate the tool using one hand.

7 Claims, 6 Drawing Sheets

HOSE CLAMP TOOL

BACKGROUND OF THE INVENTION

1. Technical Field

This invention relates to a hand tool and more particularly to a hand tool for turning the screw on a hose clamp.

2. Background Information

Hose clamp screws have a recess and/or hex head for a tool drive end to engage. The recess conventionally is a slot for a blade type driver but sometimes a star for a Phillips type driver. The majority of hose clamps have a hex head and a slot for a blade driver. Regardless of the type of drive the tool must in most instances be pushed against the screw during use and when a clamp is loose on a hose it rotates thus making the task most difficult. To stop the rotation one must apply an equal and opposite force on the clamp or screw.

Tools have been proposed that engage both the nut on a bolt and the bolt head. Reference in this regard may be had to the following United States Patents: U.S. Pat. No. 1,294,857 issued Feb. 18, 1919 to C. Yuncker; and U.S. Pat. No. 1,282,523 issued Oct. 22, 1918 to C. Bauer. The tools in these references have a shaft with a socket drive head end for drivingly engaging the head of a bolt to rotate the same and means resiliently urging it toward a an extension to the tool that has a wrench or socket to hold a nut on the bolt while the head end is rotated. With these tools one must use two hands to force the bite of the tool open against the spring pressure to get it in a work position on the bolt. This is inconvenient and awkward and doesn't leave a hand free to hold other parts and pieces as is often necessary when working with movable things such as hoses and hose clamps.

U.S. Pat. No. 2,910,899 is designed for use with a ring clamp.

SUMMARY OF INVENTION

The hose clamp tool of the present invention includes a base, an elongate post secured to and projecting upwardly from the base, and a support secured to and projecting upwardly from the base and offset laterally from the post. The support terminates in a free upper end. A flip up lid comprising a plate like member and hinge means pivotally attaching the plate like member, adjacent one edge thereof, to the upper end of the support. The lid has a slot extending inwardly from an edge thereof, opposite the hinge, to receive therein a portion of the post.

An object of the present invention is to provide a hose clamp tool wherein the clamp screw is engaged between and in axial alignment with the tool head end of a driver and an anvil on the tool and which can be readily manipulated using only one hand.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENTS

Figure 1:
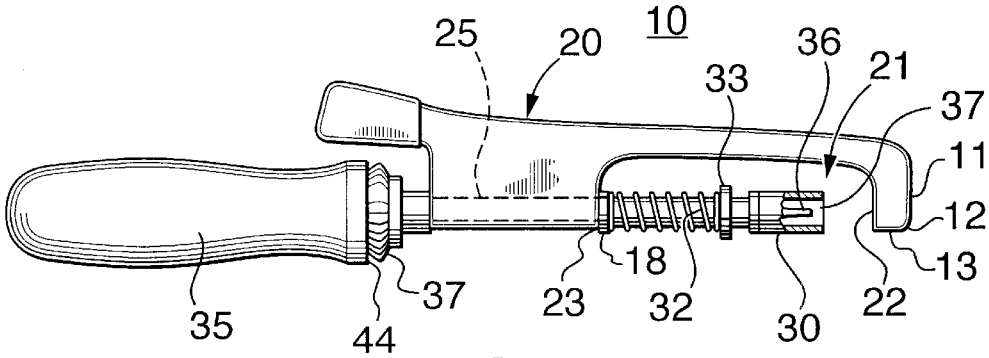
FIG. 1 is a side elevation view of a hose clamp tool provided in accordance with the present invention.
Figure 2:
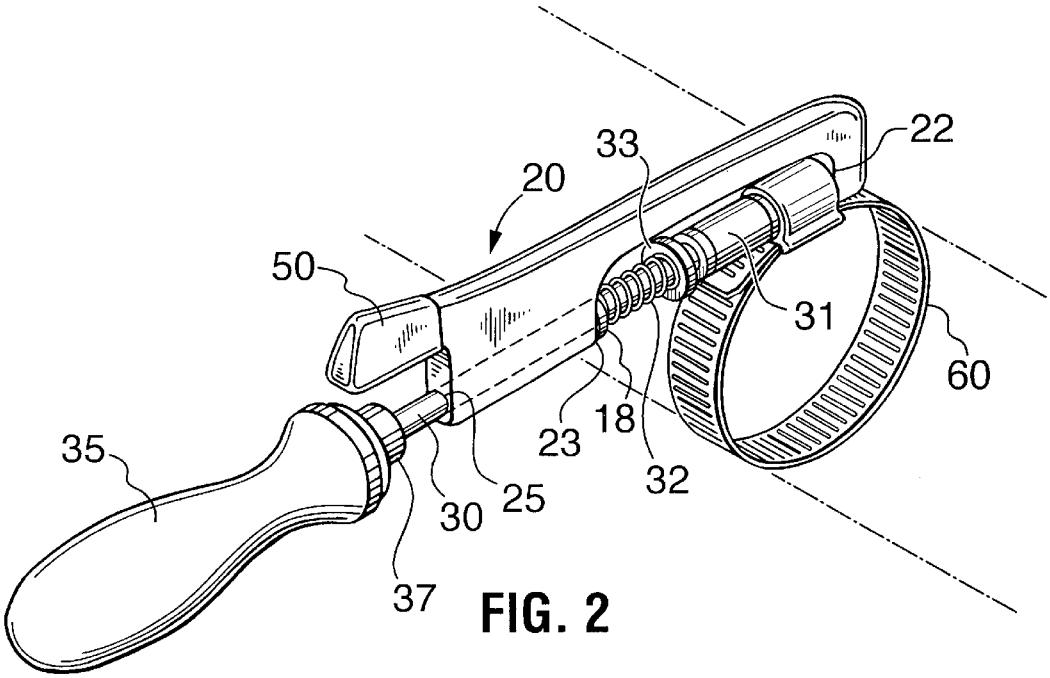
FIG. 2 is an oblique view of the hose clamp tool shown in FIG. 1.

Illustrated in the drawings, FIGS. 1–19, is a tool 10 comprising a slender elongate body member 20 or frame having a recessed portion at one end forming an open shallow "C" shaped jaw 21. The longitudinal distal end portion of the jaw 21 of the preferred embodiment further defines a finger 11 curved at about a 90 degree angle with respect to the main body member 20 defining an interior holding surface as the a first abutment 22 on the distal end of the jaw further defining an exterior shoulder portion 12 connected by an outer tip distal end 13. A second abutment 23 is located at the opposite proximate end of the jaw 21 forming an inner shoulder portion. There is a through hole 25 extending from the proximate end of the jaw 21 through the finger 11 axially aligned with the first and second abutments, 21 and 23 respectively.

Figure 3:
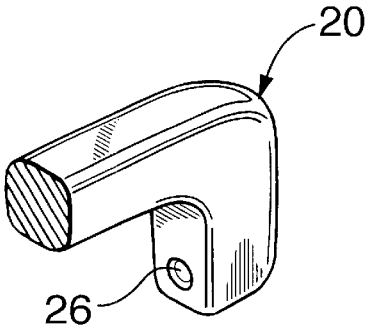
FIG. 3 is an enlarged view of an outer tip end portion of the tool shown in FIG. 1.
Figure 4:
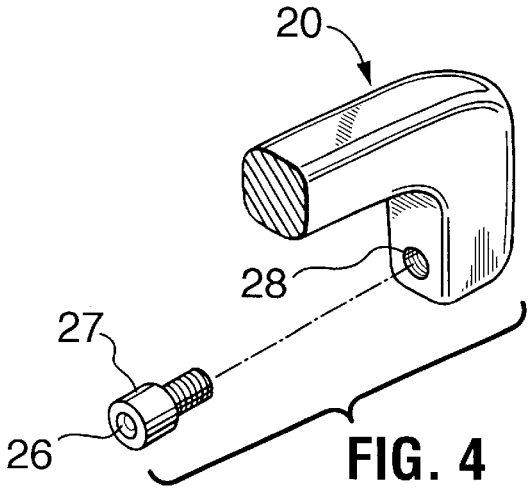
FIG. 4 is similar to FIG. 3 but illustrating an alternative construction.
Figure 8:
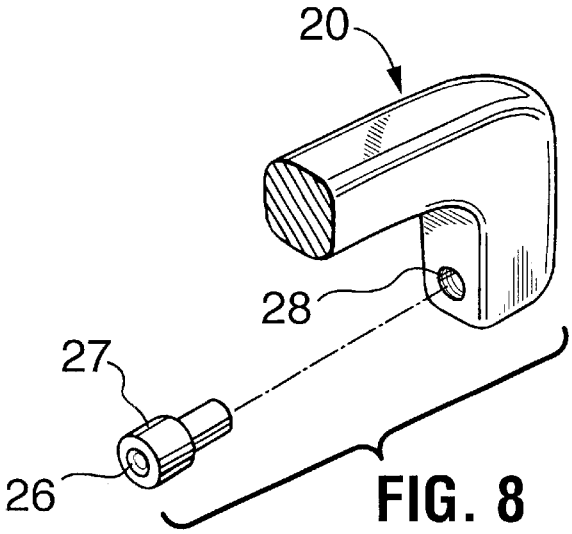
FIG. 8 is an alternate embodiment of an outer tip end portion of the tool illustrated in FIG. 1 showing the recess in the body member and a plug of a pin press fit into the aperture in the tool body member.
Figure 9:
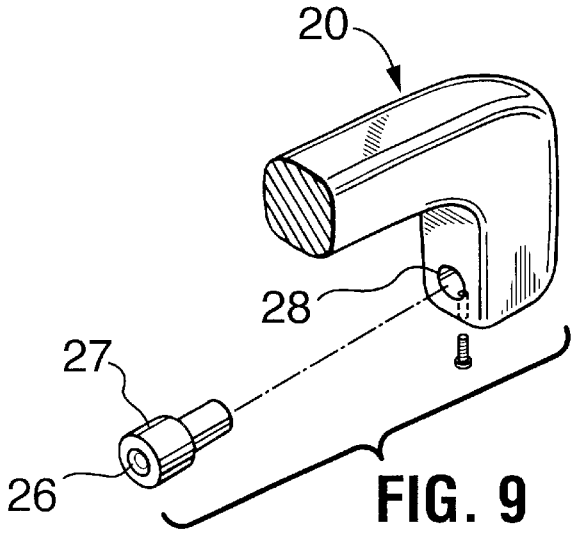
FIG. 9 is an alternate embodiment of an outer tip end portion of the tool illustrated in FIG. 1 showing the recess in the body member and a plug of a pin press fit into the aperture in the tool body member held in place with a screw disposed into the body member normal thereto in cooperative engagement therewith.
Figure 10:
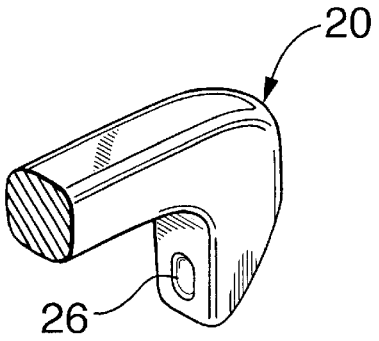
FIG. 10 is an alternate embodiment of an outer tip end portion of the tool illustrated in FIG. 1 showing the recess in the finger of the body member, wherein the aperture in the tool body member is formed integrally therewith of hard material in an elongated slot shape eliminating the need for a pin or plug and the jaw shoulder is formed at an acute angle with respect to the finger.
Figure 11:
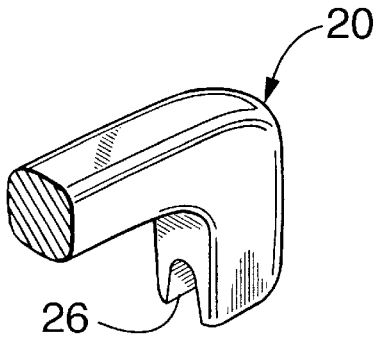
FIG. 11 is an alternate embodiment of an outer tip end portion of the tool illustrated in FIG. 1 showing the recess in the body member comprising a groove formed therein in alignment with the tool shaft for cooperatively engaging a screw mounted within a clamp.
Figure 13:
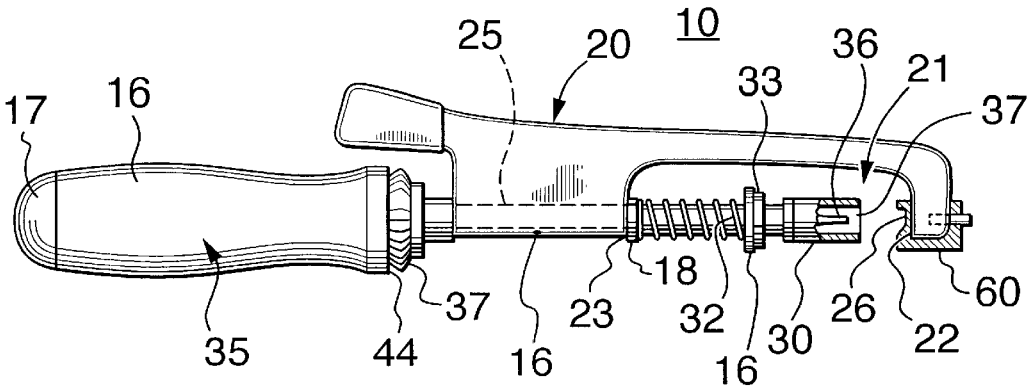
FIG. 13 is an alternate embodiment of the tool shown in FIG. 1 showing an adapter having an aperture therein as an attachment which is placed over the outer tip end of the tool and held into position by a friction fit, a tongue and groove arrangement, or snap fit.

Spaced apart from the first abutment 22 and remote from the hole 25, is an opposing aperture 28 formed in or near the distal end of the finger 11 which is also axially aligned with the hole 25. The aperture 28 may extend all the way through the finger 11 or extend only enough to form a dimple, notch, elongated notch, or circular depression defining a recess 26. During use of the tool 10, the recess 26 receives the free outer distal end of the hose clamp screw. The recess 26 may be in the finger 11 of the body member itself as shown in FIGS. 3 or be formed in a plug or cap of a pin 27 as shown in FIGS. 4 and 8 wherein it is threaded or press fit into the aperture 28 of the finger 11 of the tool body. As shown in FIG. 13, a cover cap forming an anvil 60 may be held into position over the distal end of the finger and be permanently or removably retained by a snap fit, frictional fit, retaining screw of the like, and include a recess 26 therein in alignment with the shaft 30.

Figure 14:
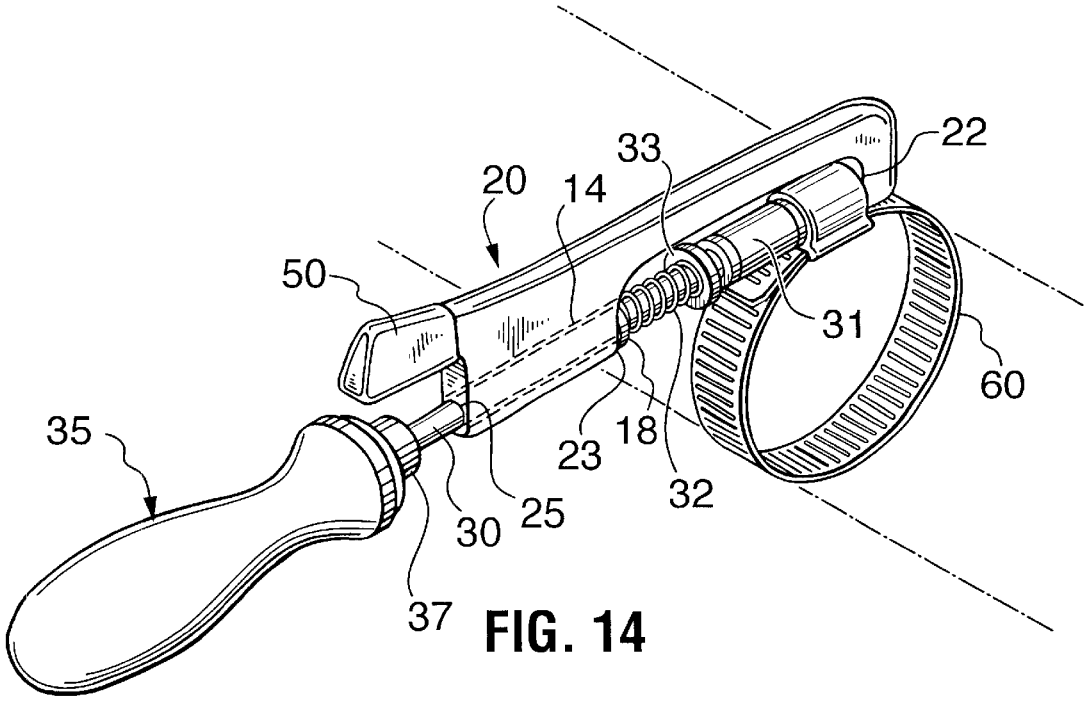
FIG. 14 is an alternate embodiment of the tool shown in FIG. 1, wherein the lug is shown including grooves formed therein for gripping.
Figure 15:
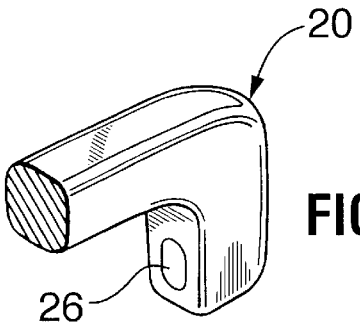
FIG. 15 is an alternate embodiment of the tool illustrated in FIG. 1 showing the recess in the body member comprising an oval shaped aperture formed therethrough in alignment with the tool shaft for sliding over a distal end of a screw of a clamp being removed and cooperatively engaging a portion of the clamp.

The shaft 30 extends through the hole 25 and has a free outer tool head end 31 adjacent said first abutment 22. Means for compressing such as a compression spring 32 is disposed coaxially on the shaft 30. The compression spring 32 has one end abutting against the second abutment 23 of the jaw 21 and the other end abutting against a spring abutment means 33 disposed on the opposing end of the shaft 30 to resiliently urge the tool head end 31 toward the first abutment 22. A preferred embodiment utilizes a washer 18 disposed between the spring 32 and the second abutment of the body 20. Means for spacing including a washer of a particular thickness or a plurality of washers 18 may be used to vary the distance the spring 32 is compressed and various size springs may be used to obtain the desired compression strength. The spring abutment means 33 can for example be a C-clip or E-clip snap fit into a groove around, a pin extending traverse to, press pinched areas, or notches in the shaft 30. A washer 15 such as shown in FIG. 13 may be used as a means for abutting the spring 32 in combination with a means for stopping comprising an C-clip, E-clip, or transverse pin, or press pinched areas on the shaft 30. It should be noted that a sleeve 14 as shown in FIG. 14 may be inserted within the body 20 coaxially around the shaft 30 to provide a strength and structural support to the body 20 if the tool body 20 is fabricated from aluminum or a plastic material. A small oil port 16 may optionally be formed or drilled into the body to lubricate the shaft 30 rotating therein.

The shaft 30 may end at the second abutment in a male or female means of attachment such as a socket so that a flexible longitudinal shaft member 19 may be permanently or removably attached thereto such as described in U.S. Pat. No. 4,876,929 by Kozak hereby incorporated by reference. The preferred embodiment would include the means for compressing or spring 32, means for holding the compression means in a compressed state coaxially around the flexible shaft 9 such as the washers 18 and 33 and means for stopping such as the c-clip 33 defined heretofore together with a selected tool head end 31 for engaging a clamp screw or bolt head.

The opposite end of the shaft 30 extends beyond the tool body 20 and the extending portion has a hand grip handle 35 is mounted thereon for use in rotating the shaft 30 with respect to the body 20. The handle 35 can be fixed to the shaft 30 or alternatively the drive end of the shaft may be a female square socket (not shown) for receiving the male square shaft of a ratchet, a power driven stub shaft on a hand drill or simply a handle 35 with a square at one end to mate with the socket. The handle 35 of the preferred embodiment is plastic; however, it is contemplated that all or a portion of the handle 35 may be rubber coated, include a knurled surface, and/or be fabricated from metal, wood, or combinations thereof. The handle 35 may comprise a hollow body cylinder 16 having a distal end with a threaded surface for cooperatively engaging an end cap 17 having threads or utilize a hollow cylindrical body wherein the end cap is frictionally held thereto for storage of bits such as illustrated in FIG. 13.

Figure 16:
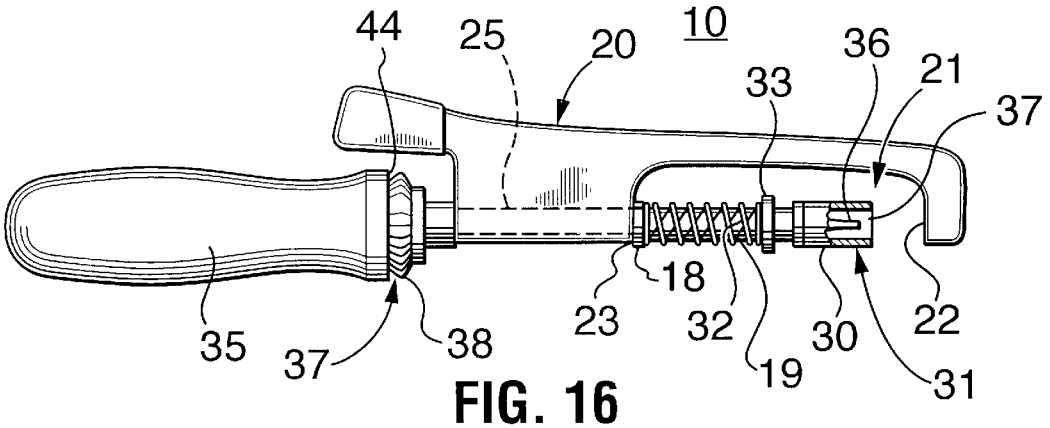
FIG. 16 is an alternate embodiment of FIG. 1, showing the shaft utilizing a flexible longitudinal shaft member within the jaw for allowing flexing of same.
Figure 17:
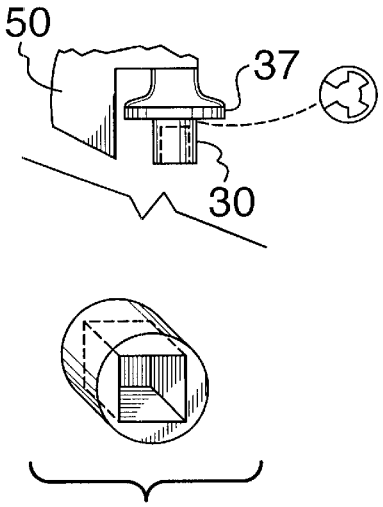
FIG. 17 is an alternate embodiment of the hose clamp tool of FIG. 1, wherein the handle has been removed to show a shaft distal end having a square shank for cooperative engagement to a ratchet, wrench, or screwdriver.
Figure 18:
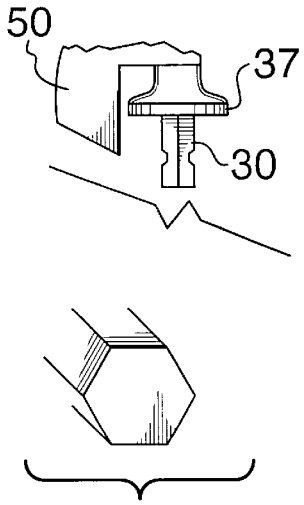
FIG. 18 is an alternate embodiment of the hose clamp tool of FIG. 1, wherein the handle has been removed to show a shaft distal end having a hexagon shaped shank for cooperative engagement to a ratchet, wrench, or screwdriver.
Figure 19:
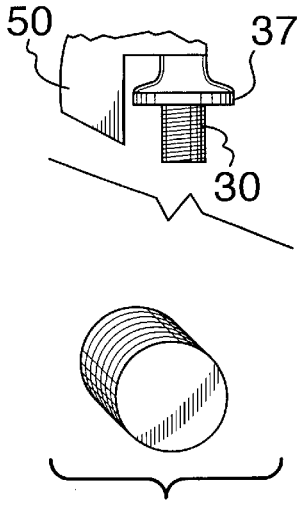
FIG. 19 is an alternate embodiment of the hose clamp tool of FIG. 1., wherein the handle has been removed to show a shaft distal end having a threaded shank for cooperative engagement to a ratchet, wrench, or screwdriver or other tool.

As shown in FIGS. 16–18, the handle 35 may be detachable and the distal end of the shaft 30 extending into the handle 35 may be formed as a square, hex, or threaded socket or male end for cooperatively engaging a ratchet, wrench such as a strong arm tool, electric screwdriver, or drill.

The tool head end 31 is shaped to match the slot, star or hex head as the case may be of the hose clamp screw. Illustrated in FIG. 1 is a blade drive 36 within an optional socket 37 (or recess) in the tool head drive end 31. The socket 37 receives a portion of the screw head end therein and this together with the recess in the abutment 22 at the end of the screw maintains the drive and screw in axial alignment. In some instances a hose clamp screw head has a slot and peripheral rib shaped like a bolt head that keeps a driver centered on the screw in which case a recess 37 is not required on the driver. For most clamps a socket matching the hex head is all that is required.

The body 20 has a projection defining a lug 50 that is readily engaged by one's thumb while the fingers of that hand are wrapped around the handle. All or a portion of the lug 50 may be covered with a plastic or rubber coating and/or include grooves or a knurled surface for gripping. The lug 50 projects from the body toward the handle 35 overlapping a portion thereof. It is thus possible to pull on the handle 35 with one's fingers on one hand while pressing the thumb on the same hand against the lug 50 to open the bite of the tool 10 against the spring pressure.

To use the tool 10 the shaft 30 is moved by hand pulling the handle 35 while holding the body or frame 20 stationery which compresses the spring 32 and retracts the shaft 30 for engaging or disengaging the head of the clamp screw with the tool head end 31 and to seat the distal end of the clamp screw within the recess 26. When the shaft 30 is released the hose clamp screw is clampingly engaged between the tool head end 31 and the first abutment 22 and drivingly engaged by the head end 31. The first abutment, being recessed as at 26, keeps the tool in position at that end and at the other end the screw head is in the tool head drive end socket 37. This arrangement maintains axial alignment of the drive shaft 30 and the hose clamp screw. Rotating the handle (by hand or power) turns the screw to tighten or loosen the clamp as desired and while doing so the web portion of the jaw engages the hose thus preventing the tool from rotating. Release of the tool is again a one hand operation. Moreover, rotating the shaft 30 in a selected direction spreads the hose clamp freeing the ribbed portions of the band which may have become embedded in the rubber material comprising the hose.

Figure 5:
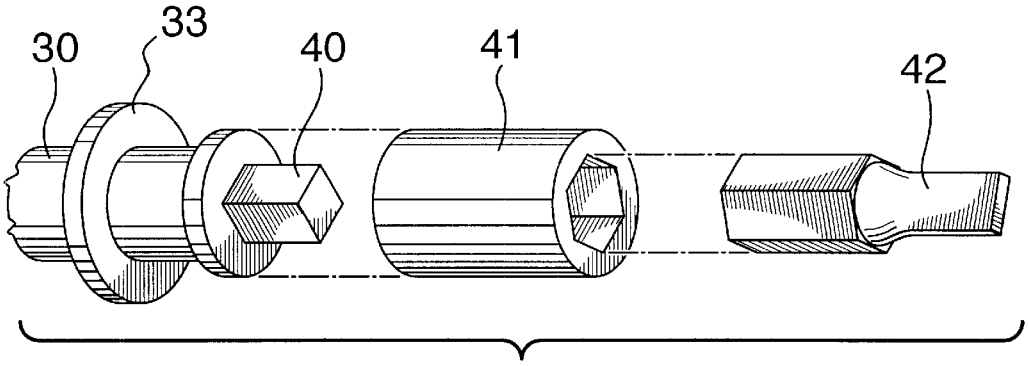
FIG. 5 is an exploded view of the drive end for the tool illustrated in FIG. 1.
Figure 6:
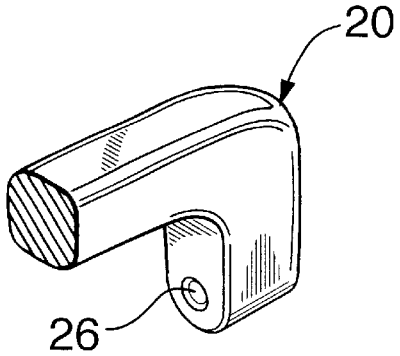
FIG. 6 is an alternate embodiment of an outer tip end portion of the tool illustrated in FIG. 1 showing the tip having a rounded shoulder wherein the hole is spaced an equal distance from the bottom and side edges of the shoulder.
Figure 7:
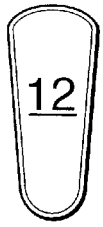
FIG. 7 is an end view of the alternate outer tip end portion of FIG. 6 showing the tip having a rounded shoulder and a wedge shape.

Details of the preferred drive head end 31 is illustrated in FIG. 5 in which a socket 41 is removably mountable on a square 40 on the end of the shaft 30. A drive element 42 is removably insertable (if the need should arise) into the socket 41 and can be chosen at the time of use to match the hose clamp screw head at hand. If a blade drive is used the socket should be deep enough to receive a portion of the head of the hose clamp screw.

Figure 12:
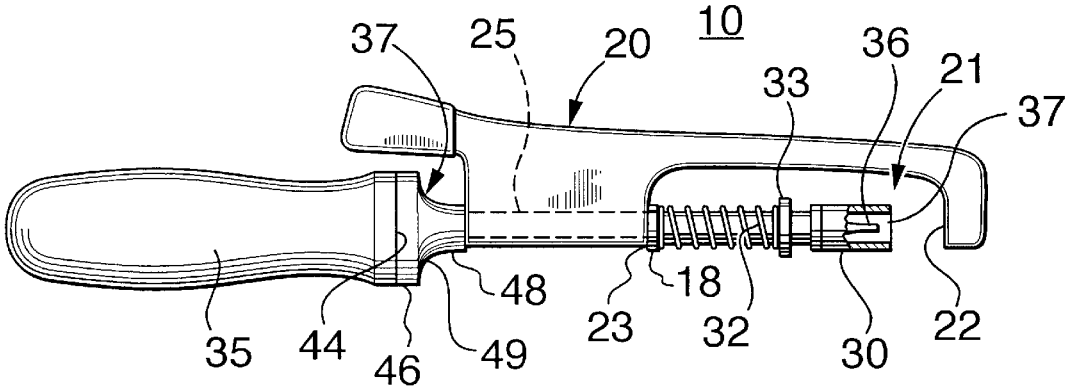
FIG. 12 is an alternate embodiment of the tool shown in FIG. 1, showing a rubber grommet having base portion sized having the same diameter of the handle and a neck portion sized in accordance with the shaft, joined by a concave tapered middle portion with is a user friendly shape.

The handle 35 has a front edge 44 against which abuts a rubber grommet 37 on the shaft. This grommet 37 has a shoulder 38. During one hand manipulation of the tool the index finger engages this shoulder while the thumb of the same hand bears against the end of the lug 50. With this grip the shaft 30 is easily forced against the force of the compression spring 32 to open the bite between abutment 22 and the drive socket. Another preferred embodiment of the tool utilizes a plastic or rubber grommet 37 as shown in FIG. 12, wherein the shoulder 38 defines a base portion 46 sized having the same diameter of the handle 35 and a neck portion 48 sized in accordance with the shaft 30 joined by a concave tapered middle portion 49 which is a user friendly shape;

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A hose clamp tool, comprising:

an elongated frame including a main body member and a recessed portion defining an open "C" shaped jaw, said jaw including an interior holding surface defining a shoulder and a distal end defining a finger in spaced apart alignment with said shoulder;

said shoulder including an axial throughbore extending therethrough in alignment with said finger;

a shaft reciprocally and rotatably disposed in said axial throughbore of said shoulder, said shaft including a free interior distal end defining means for attaching a tool head and a free outer distal end for attaching drive means to said shaft;

means for biasing said free interior distal end of said shaft toward said finger;

support means projecting from said elongated body toward said drive means.

2. The hose clamp tool of claim 1, wherein said means for biasing said free interior distal end of said shaft toward said finger is a spring.

3. The hose clamp tool of claim 1, wherein said support means projecting from said elongated body toward said drive means comprises a lug.

4. The hose clamp tool of claim 1, wherein said drive means comprises an elongated handle.

5. The hose clamp tool of claim 1, wherein said drive means is selected from the group consisting of a ratchet, a wrench, an electric screwdriver, or a drill.

6. The hose clamp tool of claim 1, wherein said free interior distal end of said shaft comprises a square end.

7. The hose clamp tool of claim 1, wherein said tool head is selected from the group consisting of a blade drive and a hex head socket.

* * * * *